US005941555A

United States Patent [19]

Dodge

[11] Patent Number: 5,941,555

[45] Date of Patent: Aug. 24, 1999

[54] SNOWBOARD BOOT BINDING MECHANISM

[75] Inventor: David J. Dodge, Shelburne, Vt.

[73] Assignee: The Burton Corporation, Burlington, Vt.

[21] Appl. No.: 08/674,976

[22] Filed: Jul. 3, 1996

Related U.S. Application Data

[63] Continuation of application No. 08/375,971, Jan. 20, 1995, abandoned.

[51] Int. Cl.[6] ..... A63C 9/00

[52] U.S. Cl. ..... 280/623; 280/624; 280/14.2

[58] Field of Search ..... 280/14.2, 11.12, 280/11.3, 600, 611, 613, 623, 624, 625, 633, 634, 635, 636; 36/117, 120, 121, 117.1, 117.3

[56] References Cited

U.S. PATENT DOCUMENTS

| | | | |
|---|---|---|---|
| Re. 26,972 | 10/1970 | Spademan . | |
| Re. 33,350 | 9/1990 | Stuart . | |
| 3,271,040 | 9/1966 | Spademan . | |
| 3,560,011 | 2/1971 | Spademan . | |
| 3,578,349 | 5/1971 | Edmund | 280/11.35 |
| 3,775,875 | 12/1973 | Dvorsky | 36/117 |
| 3,884,492 | 5/1975 | Spademan . | |
| 3,887,206 | 6/1975 | Salomon | 280/11.35 N |
| 3,900,204 | 8/1975 | Weber . | |
| 3,964,758 | 6/1976 | Kent | 280/613 |
| 3,964,761 | 6/1976 | Syrovatka | 280/623 |
| 3,988,841 | 11/1976 | Salomon . | |
| 4,026,045 | 5/1977 | Druss | 36/117 |
| 4,042,257 | 8/1977 | Salomon | 36/117 |
| 4,063,752 | 12/1977 | Whitaker et al. | 280/624 |
| 4,145,071 | 3/1979 | Salomon | 280/624 |
| 4,168,085 | 9/1979 | Faulin | 280/618 |
| 4,177,584 | 12/1979 | Beyl . | |
| 4,261,595 | 4/1981 | Smialowski et al. | 280/614 |
| 4,415,176 | 11/1983 | Hull et al. | 280/624 |
| 4,652,007 | 3/1987 | Dennis . | |
| 4,728,116 | 3/1988 | Hill | 280/618 |
| 4,741,550 | 5/1988 | Dennis | 280/618 |
| 4,964,649 | 10/1990 | Chamberlin | 280/618 |
| 4,973,073 | 11/1990 | Raines et al. | 280/624 |
| 5,035,443 | 7/1991 | Kincheloe | 280/14.2 |
| 5,054,807 | 10/1991 | Fauvet | 280/14.2 |
| 5,188,386 | 2/1993 | Schweizer | 280/607 |
| 5,299,823 | 4/1994 | Glaser | 280/625 |
| 5,417,443 | 5/1995 | Blattner et al. . | |
| 5,474,322 | 12/1995 | Perkins et al. . | |
| 5,505,478 | 4/1996 | Napoliello | 280/14.2 |
| 5,520,406 | 5/1996 | Anderson et al. | 280/14.2 |
| 5,690,351 | 11/1997 | Karol | 280/14.2 |
| 5,722,680 | 3/1998 | Dodge | 280/14.2 |

FOREIGN PATENT DOCUMENTS

| | | | |
|---|---|---|---|
| 255325 | 7/1961 | Australia | 280/635 |
| 0059022 | 9/1982 | European Pat. Off. | 36/117 |
| 0398794 | 11/1990 | European Pat. Off. | 280/14.2 |
| 2 148 501 | 3/1973 | France . | |
| 2 689 776 | 10/1993 | France . | |
| 7-303728 | 11/1995 | Japan . | |
| 678494 A5 | 9/1991 | Switzerland . | |
| 94 13 356 | 1/1995 | United Kingdom . | |
| WO 96/05894 | 2/1996 | WIPO . | |
| WO 96/26774 | 6/1996 | WIPO . | |

OTHER PUBLICATIONS

Partial Translation of JP 7–303728.

*Primary Examiner*—Robert J. Oberleitner
*Assistant Examiner*—Faye M. Fleming
*Attorney, Agent, or Firm*—Wolf, Greenfield & Sacks, P.C.

[57] ABSTRACT

A snowboard boot binding mechanism includes a base member having a recessed channel. A first plate is slidably attached to the base member. A first pair of engagement rods are fixedly attached to the first plate. Each of the first pair of engagement rods has a head disposed at an axial end of the rod for selectively engaging and locking a first bar attached to a first side of the snowboard boot. A second plate is fixedly attached to the base member. A second pair of engagement rods are fixedly attached to the second plate. Each of the second pair of engagement rods have a head disposed at an axial end of the rod for engaging and locking a second bar attached to a second side of the snowboard boot which is disposed opposite to the first side.

108 Claims, 3 Drawing Sheets

SNOWBOARD BOOT BINDING MECHANISM

This is a continuation of application Ser. No. 08/375,971, filed Jan. 20, 1995, now abandoned.

BACKGROUND OF THE INVENTION

1. Field of the Invention

The present invention relates generally to boot binding mechanisms. More specifically, the present invention relates to a snowboard boot binding mechanism that has a pair of engagement rods fixedly attached to a fixed plate and a second pair of engagement rods fixedly attached to a slidably movable plate to selectively engage and lock a snowboard boot in the boot binding mechanism.

2. Description of the Related Art

A recently popular sport, snowboarding presents operating conditions and physical demands to boot bindings that are somewhat dissimilar to other skiing-type sports. That is because in snowboarding, the operator stands with both feet on the snowboard such that both feet are typically disposed at an angle with respect to the longitudinal direction of the ski. Given the sophisticated structure of presently manufactured boots for ski-type sports and the operating conditions the boots are subject to, a reliable and tight connection in between the boot and the snowboard is required.

An attempted solution to this problem is disclosed in U.S. Pat. No. 4,973,073 to Raines et al., issued on Nov. 27, 1990. The boot sole 40 of Raines is modified to have a binding ridge 42, 50 placed on each side of the boot. Ridge 42 is received in a fixed entrapment member 60 and ridge 50 is received by a pivoting entrapment member 70. To release a bound boot 18, the user simply pushes the handle 102 away from the boot until the hooking lip 76 is in an open position and the second binding bridge 50 can be lifted out of the second socket 72. Accordingly, during use the snowboard binding can be rather easily inadvertently opened if handle 102 or any part of member 70 is accidentally pushed away from the boot.

U.S. Pat. No. 4,063,752 to Whittaker issued on Dec. 20, 1977 discloses a ski binding that includes two opposing latch members 28 that each move towards and away from each other to control the latch operation. An engagement plate 32 is secured to the bottom of the boot by screws and has latch receiving formations 34 disposed at its marginal edges.

Notwithstanding the foregoing boot binding mechanisms, there are still major problems involved. The binding mechanisms are typically mounted on the ski or snowboard and are disposed in such a matter that outside forces can easily cause an accidental release of the binding mechanism. Accordingly, it is an object of the present invention to provide a snowboard boot binding mechanism that permits selective engagement and locking of the snowboard boot while simultaneously preventing an inadvertent release of the boot from the locked position. It is a further object of the present invention to provide a boot binding mechanism that includes a base member which acts as a housing to enclose most of the moving parts of the boot binding mechanism to thereby minimize the risk of an accidental release of the binding from the locked position. It is a further object to provide a boot binding mechanism that permits the binding mechanism to clamp the boot sole from the side, i.e., from the in-step area of the foot. It is a further object to provide a snowboard boot binding mechanism that requires less parts and thus, is smaller and easier to manufacture. It is still a further object of the present invention that the snowboard boot binding mechanism be simple and cost effective to manufacture, yet reliable and efficient in use.

SUMMARY OF THE INVENTION

In accordance with a preferred embodiment demonstrating further objects, features and advantages of the invention, a snowboard boot binding mechanism includes a base member having a recessed channel. A first plate is slidably attached to the base member. A first pair of engagement rods are fixedly attached to the first plate. Each of the first pair of engagement rods have a head disposed at an axial end of the rod for selectively engaging and locking a first bar attached to a first side of the snowboard boot. A second plate is fixedly attached to the base member. A second pair of engagement rods are fixedly attached to the second plate. Each of the second pair of engagement rods having a head disposed at an axial end of the rod for engaging and locking a second bar attached to a second side of the snowboard boot which is disposed opposite to the first side.

BRIEF DESCRIPTION OF THE DRAWINGS

The above and still further objects, features and advantages of the present invention will become apparent upon consideration of the following detailed description of a specific embodiment thereof, especially when taken in conjunction with the accompanying drawings wherein like reference numerals in the various figures are utilized to designate like components, and wherein.

DETAILED DESCRIPTION OF THE PRESENTLY PREFERRED EMBODIMENTS

Figure 1:
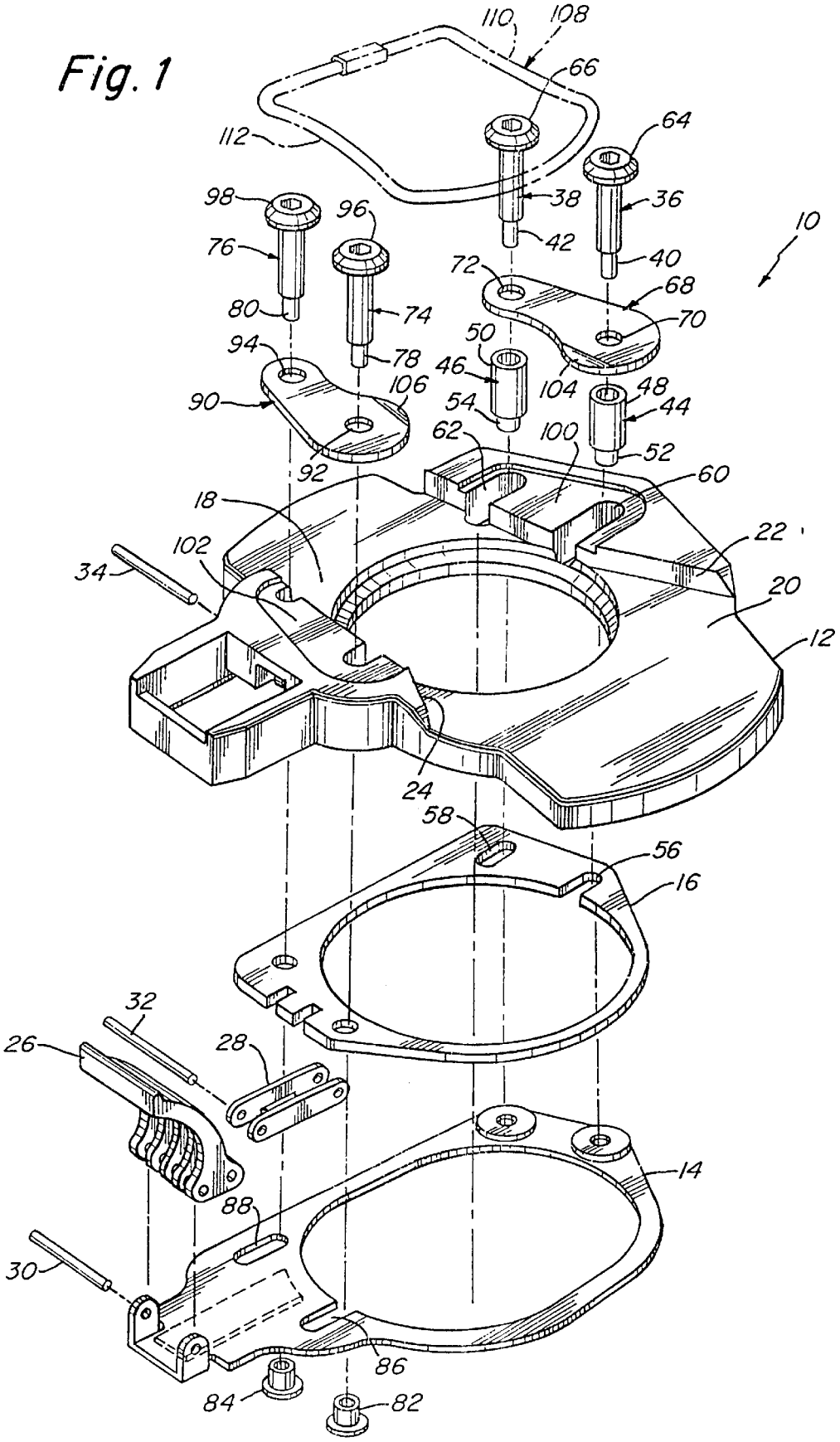
FIG. 1 is an exploded view of a boot binding mechanism according to the present invention.

Referring now to FIG. 1, a snowboard boot binding mechanism 10 is illustrated. The boot binding mechanism includes a base member 12, a first plate 14 and a second plate 16. The base member 12 has a recessed channel 18 that includes an upper surface 20 and two sidewalls surfaces 22, 24 to receive a snowboard boot.

The first plate 14 is slidably attached to base member 12 through a pivoting handle member 26 and a pivoting link arm member 28. A pin 30 is used to pivotally connect handle member 26 to first plate 14. A second pin 32 is used to pivotally connect handle member 26 to link 28. The opposite end of link 28 is pivotally connected to base member 12 by pin 34.

A first pair of engagement rods 36, 38 are fixedly attached to first plate 14. The rods 36, 38 are integrally connected to first plate 14 at their lower axially ends 40, 42, respectively; it being understood that relative orientation adjectives such as "upper", "lower", etc. are utilized herein to simplify the present description and are not intended to limit the orientation of the binding mechanism when mounted for use. The rods 36, 38 are preferably connected to plate 14 by riveting. However, any other suitable means for fixedly attaching the rods to the plate may be used. Each rod 36, 38 passes through a spacer sleeve 44, 46, respectively. Each spacer sleeve 44, 46 has a stepped outer diameter portion including a larger diameter portion 48, 50 and a smaller diameter portion 52, 54, respectively. The smaller diameter portions 52, 54 are received in elongated slots 56, 58, respectively in second plate 16, whereas the larger diameter portions 44, 46 are received in elongated slots 60, 62, respectively, in the base member 12. The upper axially ends of the rods 36, 38 have a head or plate-shaped portion 64, 66. An engagement plate 68 has a pair of throughholes 70, 72 to receive the larger diameter portion of rods 36, 38. Thus, engagement plate 68 is disposed about engagement rods 36, 38 and between head portions 64, 66 and spacer sleeves 44, 46. The spacer sleeves are utilized to help absorb some of the bending forces that may be applied against rods 36, 38. Additionally, engagement plate 68 is used to help transfer some of the bending forces that may be applied to rods 36, 38 into tensile forces. Of course, axial forces in rods 36, 38 are preferred over bending forces.

Figure 3:
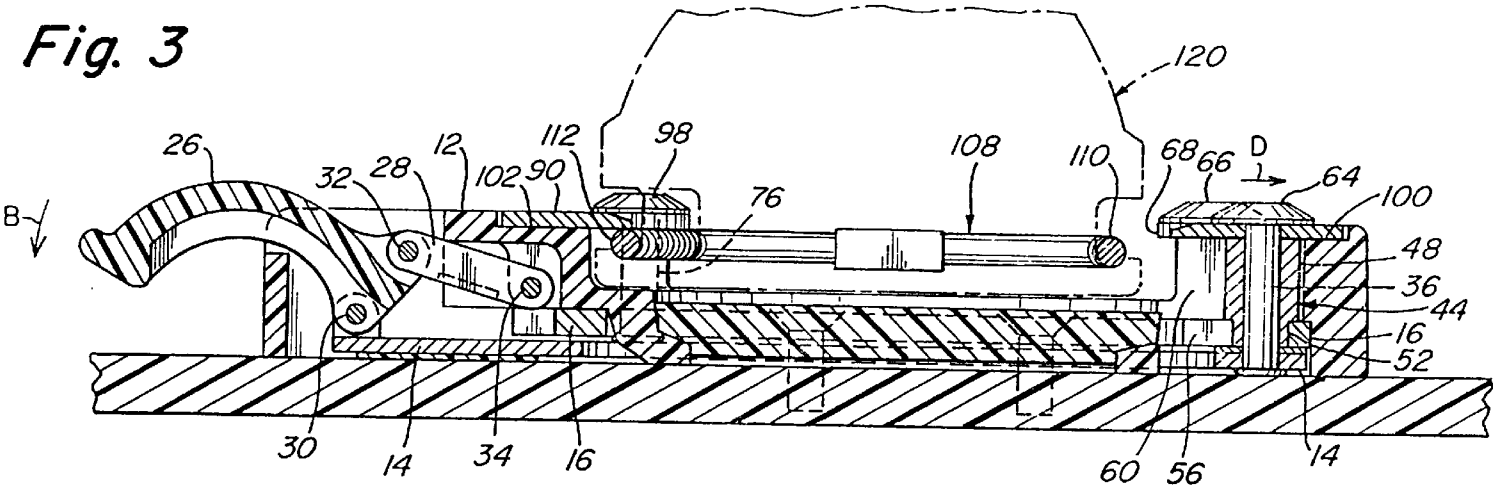
FIG. 3 is a sectional view taken along lines 3—3 of FIG. 2 and looking the direction of the arrows.
Figure 4:
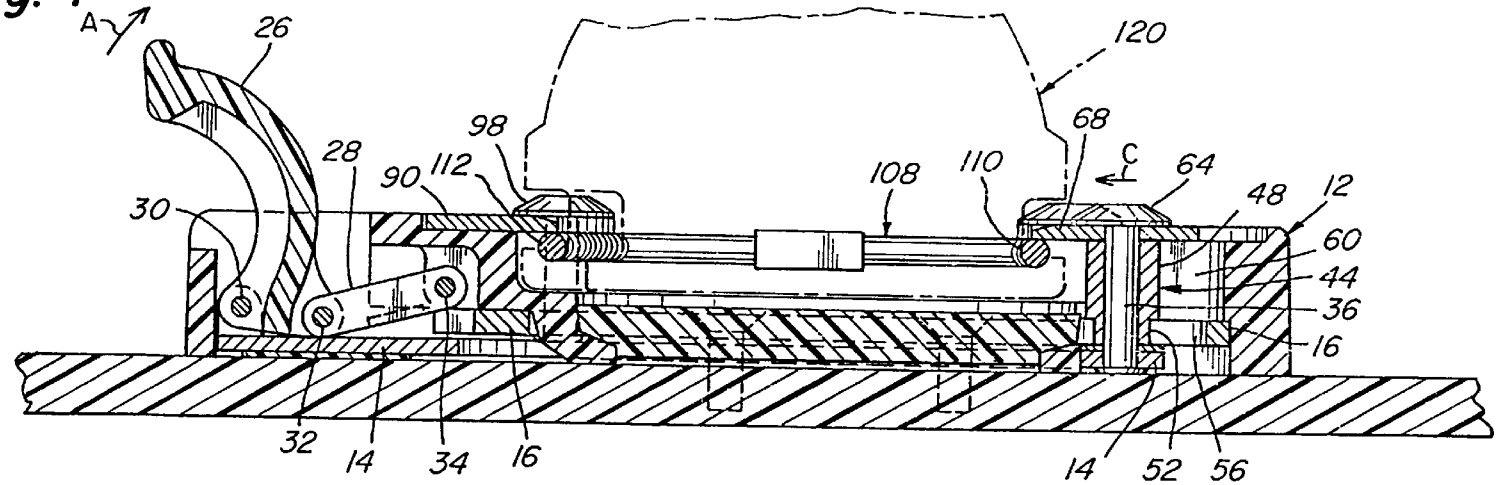
FIG. 4 is a sectional view similar to FIG. 3 except that the boot binding mechanism is in the locked position.

A second pair of engagement rods 74, 76 are fixedly attached to second plate 16 in a similar manner in which the first pair of engagement rods 36, 38 are fixedly attached to the first plate 14. The pairs of engagement rods are preferably fixedly attached to the plates by a press fit. However, any suitable manner of fixedly attaching these two members together such as welding, shrink-fitting, etc. may be used. The lower ends 78, 80, respectively of the second pair of engagement rods 74, 76 have a reduced diameter portion which are sized to fit within a pair of shoulder bushings 82, 84. The shoulder bushings 82, 84 help guide a sliding motion of the first plate 14 because they are received in elongated slots 86, 88, respectively. A second engagement plate 90 is mounted about the second pair of engagement rods 74, 76 via their respective throughholes 92, 94. Engagement plate 90 is mounted just below the heads 96, 98 of the engagement rods 74, 76, respectively. Engagement plate 68 is slidably supported on a slightly recessed, substantially planer surface 100 in base member 12. Likewise, engagement plate 90 is slidably supported on a slightly recessed, substantially planer support surface 102. Plates 68, 90, also have beveled edge portions 104, 106 to permit a bar member 108, which is in the form of a closed loop and is embedded in a sole of snowboard boot, to more easily engage into a position below plate 68 90. Bar member 108 has at least two exposed side portions 110, 112, which correspond to the in-step area of the user's foot. Bar member 108 may alternatively not be embedded in the sole, but may be connected to the sole of the snowboard boot, with or without a reinforcing plate depending on the stresses that will be applied to the bar. Side portions 110, 112 are exposed at least along their upper surface, as illustrated in FIGS. 3 and 4 so that the upper portion of the side 110 can be selectively engaged with the first pair of engagement rods 36 and 38 such that the head portions 64, 66 and the engagement plate 68 lock the boot in the binding mechanism as illustrated in FIG. 4. The opposite side 112 of the bar member 108 is exposed along its upper surface to permit head portions 96, 98 of the second pair of engagement rods 74, 76 and engagement plate 90 to engage and to lock the snowboard boot in the binding mechanism when the first plate is in the locked position as illustrated in FIG. 4.

Figure 2:
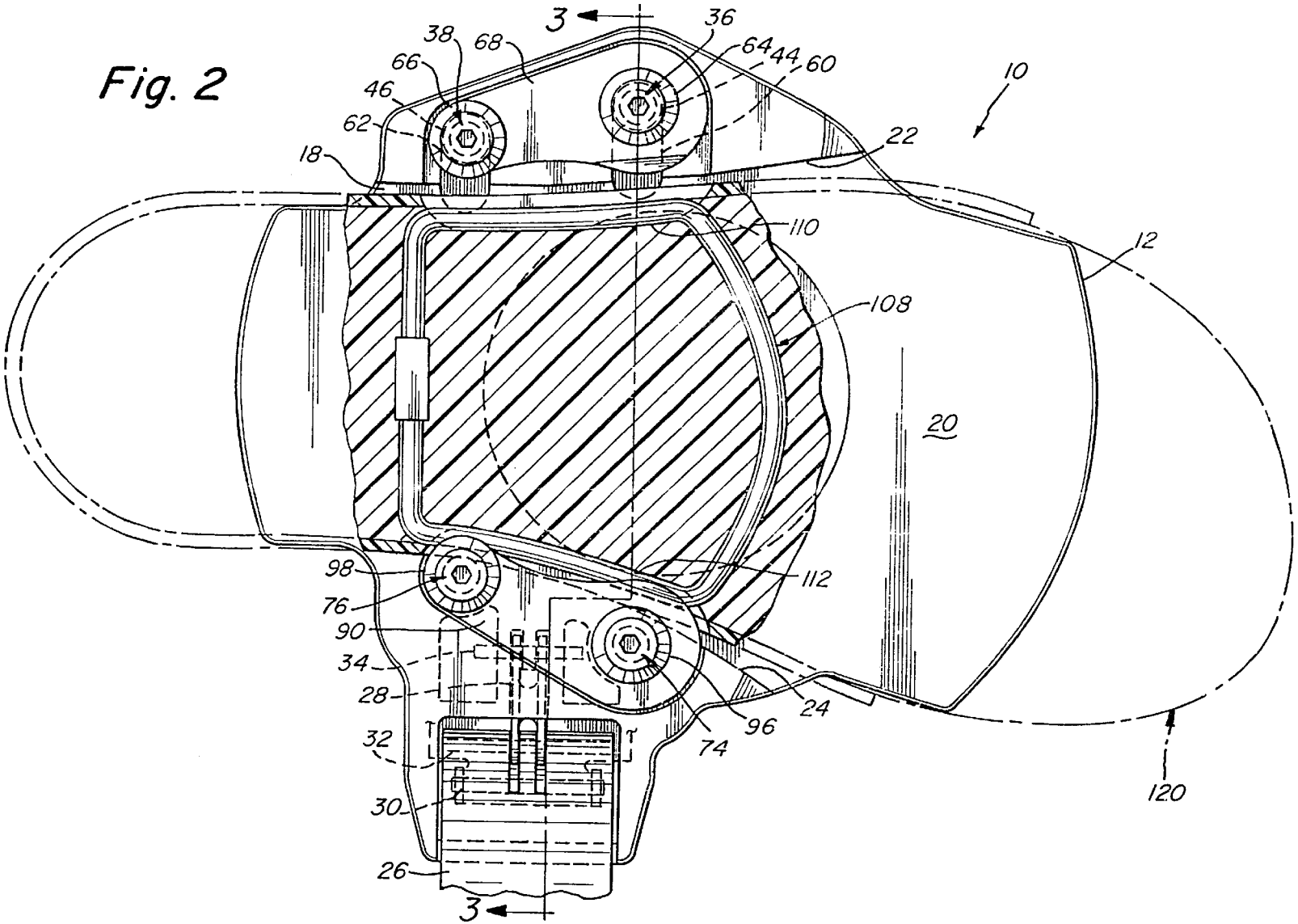
FIG. 2 is a partial sectional top view of a snowboard boot engaged in the boot binding mechanism and in the unlocked position.

The operation of the boot binding mechanism will be described below with reference to FIGS. 2–4. A user wearing a snowboard boot 120 having a closed loop bar member 108 embedded in its sole steps within the open binding mechanism and positions the second side 112 of the bar member 108 into the engaged position below heads 96, 98 and below engagement plate 90 as illustrated in FIGS. 2 and 3.

The lock the boot within the binding mechanism the user then pulls upwardly on handle member 26 in the direction indicated by arrow A in FIG. 4. This upper movement of handle member 26 causes handle member 26 to rotate in the direction indicated by arrow A and to translate in a direction indicated by arrow C in FIG. 4. At the same time, link member 28 pivots about fixed pin 34 in the direction indicated by arrow B, which is opposite to the direction of arrow A. Additionally, simultaneously with the pivoting movements, first plate 14 is slidably moved in the direction indicated by arrow C from the open position as illustrated in FIG. 3 to the closed position as illustrated in FIG. 4. As can be seen in FIGS. 3 and 4, as handle member 26 is pivoted in the upward position, pivot pin 30 slides in the direction indicated by arrow C. When pin 32 passes over an imaginary line extending between pins 30, 34, the handle reaches what is known as a centered position. In this centered position the handle is instable and the handle will then tend to snap into the closed position as illustrated in FIG. 4. In the closed position, the handle is in what is known as an over-centered position. The first set of engagement rods 36, 38 are moved from the open position as illustrated in FIG. 3 to the closed position as illustrated in FIG. 4, such that the heads 64, 66 and the engagement plate 658 selectively engage and lock the first side 110 of the bar member 108 in the boot binding mechanism. If desired, a conventional latch (not shown) may be placed onto handle member 26 to further prevent an inadvertent pivoting of the handle member. However, in most cases the pressure applied from the boot and the base member will be sufficient to maintain the handle in the stable, over-centered position illustrated in FIG. 4.

To unlock the boot, the user simply pushes down and rotates handle member 26 in the direction indicated by arrow B in FIG. 3. Because of the linkage mechanism, this movement will cause handle member 26 to rotate in the direction indicated by arrow B and to translate in the direction indicated by arrow D. Thus, because of the link between the first plate 14 and the handle member 26, the second plate 14 is slidably moved in the direction indicated by arrow D to the open position as illustrated in FIG. 3. The user can now simply step out of the boot binding mechanism.

Having described the presently preferred exemplary embodiment of a new and improved snowboard boot binding mechanism, in accordance with the present invention, it is believed that other modifications, variations and changes will be suggested to those skilled in the art in view of the teachings set forth herein. It is, therefore, to be understood that all such variations, modifications, and changes are believed to fall within the scope of the present invention as defined by the appended claims.

What is claimed is:

1. A snowboard boot binding, comprising:

a base adapted to receive a snowboard boot;

a first plate slidably attached to said base;

a first engagement member fixedly attached to said first plate, said first engagement member being adapted to engage a first side of the snowboard boot;

a second engagement member fixedly attached to said base, said second engagement member being adapted to engage a second side of the snowboard boot which is disposed opposite the first side;

a handle pivotally connected to said first plate; and a link pivotally connected to said handle, said link being further pivotally connected to said base.

2. A snowboard boot binding according to claim 1, wherein said first engagement member includes a first pair of engagement rods fixedly attached to said first plate and a first engagement plate fixedly attached to said first pair of engagement rods.

3. A snowboard boot binding according to claim 2, wherein said second engagement member includes a second pair of engagement rods fixedly attached to said base and a second engagement plate fixedly attached to said second pair of engagement rods.

4. A snowboard boot binding according to claim 3, wherein said first pair of engagement rods includes first and second engagement rods, said second pair of engagement rods includes third and fourth engagement rods, and wherein each one of said first, second, third and fourth engagement rods includes a head disposed at an axial end of said one of said engagement rods.

5. A snowboard boot binding according to claim 1, in combination with said snowboard boot, wherein said snowboard boot includes first and second bars respectively attached to said first and second sides of said snowboard boot, wherein said first bar and said second bar are integrally connected together, and wherein said first and second engagement members are respectively adapted to engage the first and second bars.

6. The combination according to claim 5, wherein said first bar and said second bar form a closed loop embedded in a sole of the boot.

7. A snowboard boot binding, comprising:

a base;

a first pair of engagement members supported by said base and adapted to engage a first side of the snowboard boot when said binding is in a closed configuration, said first pair of engagement members including first and second spaced apart engagement members adapted to separately engage first and second sections of the first side of the snowboard boot while being spaced from a third section of the first side of the snowboard boot disposed therebetween; and a third engagement member supported by said base, said third engagement member being adapted to engage a second side of the snowboard boot disposed opposite the first side.

8. A snowboard boot binding according to claim 7, further comprising a handle mechanically coupled to said first pair of engagement members.

9. A snowboard boot binding according to claim 8, further comprising a link pivotally connected to said base.

10. A snowboard boot binding according to claim 9, wherein said handle is pivotally connected to said link.

11. A snowboard boot binding according to claim 10, further comprising a first engagement plate fixedly attached to said first pair of engagement members.

12. A snowboard boot binding according to claim 11, wherein said third engagement member includes a second pair of spaced apart engagement members, and wherein said binding further comprises a second engagement plate fixedly attached to said second pair of engagement members.

13. A snowboard boot binding according to claim 7, in combination with said snowboard boot, wherein said snowboard boot includes first and second bars respectively attached to said first and second sides of said snowboard boot, said first bar and said second bar being integrally connected together, and wherein said first pair of engagement members is adapted to engage the first bar and the third engagement member is adapted to engage the second bar.

14. A combination according to claim 13, wherein said first bar and said second bar are in the shape of a closed loop and are embedded in a sole of said snowboard boot.

15. A snowboard boot binding according to claim 7, further comprising a first engagement plate fixedly attached to said first pair of engagement members.

16. A snowboard boot binding according to claim 15, wherein said third engagement member includes a second pair of spaced apart engagement members, and wherein said binding further comprises a second engagement plate fixedly attached to said second pair of engagement members.

17. A snowboard boot binding according to claim 1, wherein said handle and said link are constructed and arranged so that when said handle is pivoted upwardly away from said base, said first plate slides to move said first engagement member toward said second engagement member.

18. A snowboard boot binding according to claim 1, wherein said binding has open and closed configurations, and wherein:

said handle is pivotally connected to said first plate at a first pivot point;

said link is pivotally connected to said handle at a second pivot point;

said link is pivotally connected to said base at a third pivot point;

said binding has a locking axis that passes through the second and third pivot points; and said first pivot point is positioned above the locking axis when said binding is in the closed configuration.

19. A snowboard boot binding according to claim 1, wherein said handle is pivoted in a first direction to close said binding, and wherein said handle and said link are constructed and arranged so that when said binding is closed, compression forces generated by the snowboard boot on said link act to pivot said handle in the first direction.

20. A snowboard boot binding according to claim 1, wherein said first engagement member includes a first pair of spaced apart engagement rods fixedly attached to said first plate.

21. A snowboard boot binding according to claim 20, wherein said second engagement member includes a second pair of spaced apart engagement rods fixedly attached to said second plate.

22. A snowboard boot binding according to claim 1, in combination with said snowboard boot, wherein:

said first and second sides of said snowboard boot respectively have first and second recesses;

said first engagement member is adapted to engage the first recess when said binding is in a closed configuration;

said second engagement member is adapted to engage the second recess when said binding is in the closed configuration;

said first engagement member is beveled; and said first engagement member and the first recess are constructed and arranged so that clearance is provided between said first engagement member and said first side of the snowboard boot when said first engagement member is disposed within the recess when said binding is in the closed configuration.

23. A combination according to claim 22, wherein:

said second engagement member is beveled; and said second engagement member and the second recess are constructed and arranged so that clearance is provided between said beveled second engagement member and said second side of the snowboard boot when said second engagement member is disposed within the second recess when said binding is in the closed configuration.

24. A snowboard boot binding according to claim 1, wherein said first engagement member includes a first pair of engagement surfaces including first and second spaced apart engagement surfaces adapted to separately engage first and second sections of the first side of the snowboard boot while being spaced from a third section of the first side of the snowboard boot disposed therebetween.

25. A snowboard boot binding according to claim 24, wherein said second engagement member includes a second pair of engagement surfaces including third and fourth spaced apart engagement surfaces adapted to separately engage first and second sections of the side of the snowboard boot while being spaced from a third section of the second side of the snowboard boot disposed therebetween.

26. A snowboard boot binding according to claim 24, wherein said handle is pivoted in a first direction to close said binding, and wherein said handle and said link are constructed and arranged so that when said binding is closed, compression forces generated by the snowboard boot on said link act to pivot said handle in the first direction.

27. A snowboard boot binding according to claim 24, wherein said handle and said link are constructed and arranged so that when said handle is pivoted upwardly away from said base, said first plate slides to move said first engagement member toward said second engagement member.

28. A snowboard boot binding according to claim 27, wherein said handle is pivoted in a first direction to close said binding, and wherein said handle and said link are constructed and arranged so that when said binding is closed, compression forces generated by the snowboard boot on said link act to pivot said handle in the first direction.

29. A snowboard boot binding according to claim 8, wherein said first pair of engagement members is slidably attached to said base, and wherein said binding is constructed and arranged so that when said handle is pivoted upwardly away from said base, said first pair of engagement members moves toward said third engagement member.

30. A snowboard boot binding according to claim 29, wherein said third engagement member includes a second pair of engagement surfaces including third and fourth spaced apart engagement surfaces adapted to separately engage first and second sections of the second side of the snowboard boot while not engaging a third section of the second side of the snowboard boot disposed therebetween.

31. A snowboard boot binding according to claim 10, wherein said handle is pivoted in a first direction to close said binding, and wherein said handle and said link are constructed and arranged so that when said binding is closed, compression forces generated by the snowboard boot on said link act to pivot said handle in the first direction.

32. A snowboard boot binding according to claim 31, wherein said third engagement member includes a second pair of engagement surfaces including third and fourth spaced apart engagement surfaces adapted to separately engage first and second sections of the second side of the snowboard boot while being spaced from a third section of the second side of the snowboard boot disposed therebetween.

33. A snowboard boot binding according to claim 7, wherein said third engagement member includes a second pair of engagement surfaces including third and fourth spaced apart engagement surfaces adapted to separately engage first and second sections of the second side of the snowboard boot while being spaced from a third section of the second side of the snowboard boot disposed therebetween.

34. A snowboard boot binding according to claim 10, further including a plate slidably attached to said base, said first pair of engagement members being fixed to said plate, said handle being pivotally connected to said first pair of engagement members via pivotal connection between said handle and said plate.

35. A snowboard boot binding according to claim 7 in combination with said snowboard boot, wherein:

said first side of said snowboard boot includes first and second recesses;

said second side of said snowboard boot includes a third recess;

said first pair of engagement members is adapted to engage the first and second recesses when said binding is in a closed configuration;

said second engagement member is adapted to engage the third recess when said binding is in the closed configuration;

said first engagement member is beveled; and said first pair of engagement members and the first and second recesses are constructed and arranged so that clearance is provided between said first pair of engagement members and said first side of the snowboard boot when said first pair of engagement members is disposed within the first and second recesses when the binding is in the closed configuration.

36. A combination according to claim 35 wherein:

said second engagement member is beveled; and said second engagement member and the second recess are constructed and arranged so that clearance is provided between said beveled second engagement member and said second side of the snowboard boot when said second engagement member is disposed within the second recess when the binding is in the closed configuration.

37. A snowboard boot binding comprising:

a base adapted to receive a snowboard boot;

a first engagement member slidably attached to said base, said first engagement member being adapted to engage a first side of the snowboard boot when said binding is in a closed configuration;

a second engagement member fixedly attached to said base, said second engagement member being adapted to engage a second side of the snowboard boot opposite the first side when said binding is in the closed configuration; and a handle supported by the base and mechanically coupled to said first engagement member so that actuation of said handle upwardly away from said base slides said first engagement member toward said second engagement member to place said binding into the closed configuration.

38. A snowboard boot binding according to claim 37, wherein the first engagement member includes a first pair of engagement surfaces including first and second spaced apart engagement surfaces adapted to separately engage first and second sections of the first side of the snowboard boot while being spaced from a third section of the first side of the snowboard boot disposed therebetween.

39. A snowboard boot binding according to claim 37, wherein said second engagement member includes a second pair of engagement surfaces including third and fourth spaced apart engagement surfaces adapted to separately engage first and second sections of the second side of the snowboard boot while being spaced from a third section of the second side of the snowboard boot disposed therebetween.

40. A snowboard boot binding according to claim 37, wherein said handle is actuated in a first direction to close said binding, and wherein said binding is constructed and arranged so that when said binding is closed, compression forces generated by the snowboard boot on said link act to actuate said handle in the first direction.

41. A snowboard boot binding according to claim 37, further comprising a link pivotally connected to said base, said handle being pivotally connected to said link.

42. A snowboard boot binding according to claim 41, wherein said handle is pivoted in a first direction to close said binding, and wherein said handle and said link are constructed and arranged so that when said binding is closed, compression forces generated by the snowboard boot on said link act to pivot said handle in the first direction.

43. A snowboard boot binding according to claim 37, in combination with said snowboard boot, wherein:

said first and second sides of said snowboard boot respectively have first and second recesses;

said first engagement member is adapted to engage the first recess when said binding is in the closed configuration;

said second engagement member is adapted to engage the second recess when said binding is in the closed configuration;

said first engagement member is beveled; and said first engagement member and the first recess are constructed and arranged so that clearance is provided between said first engagement member and said first side of the snowboard boot when said first engagement member is disposed within the recess when the binding is in the closed configuration.

44. A snowboard boot binding, comprising:

a base adapted to receive a snowboard boot;

a first engagement member supported by said base, said first engagement member being adapted to engage a first side of the snowboard boot when said binding is in a closed configuration;

a second engagement member supported by said base, said second engagement member being adapted to engage a second side of said snowboard boot opposite the first side when said binding is in the closed configuration; and a handle mechanically coupled to said first engagement member so that actuation of the handle in a first direction moves said first engagement member toward said second engagement member to move said binding into the closed configuration, and so that compression forces generated by the snowboard boot on said binding that tend to move said first engagement member away from said second engagement member when the binding is in the closed configuration tend to actuate said handle in the first direction.

45. A snowboard boot binding according to claim 44, wherein the first engagement member includes a first pair of engagement members including first and second spaced apart engagement surfaces adapted to separately engage first and second sections of the first side of the snowboard boot while not engaging a third section of the first side of the snowboard boot disposed therebetween.

46. A snowboard boot binding according to claim 44, in combination with said snowboard boot, wherein:

said first and second sides of said snowboard boot respectively have first and second recesses;

said first engagement member is adapted to engage the first recess when said binding is in the closed configuration;

said second engagement member is adapted to engage the second recess when said binding is in the closed configuration;

said first engagement member is beveled; and said first engagement member and the first recess are constructed and arranged so that clearance is provided between said first engagement member and said first side of the snowboard boot when said first engagement member is disposed within the recess when the binding is in the closed configuration.

47. A snowboard boot binding according to claim 44, further comprising a link pivotally connected to said base, said handle being pivotally connected to said link.

48. A system comprising:

a snowboard boot having first and second sides, said first side including at least one recess periphery that defines at least one recess in the first side, the at least one recess periphery having a top surface and a bottom surface; and a binding that includes;

a base adapted to receive the snowboard boot;

a first engagement member supported by said base, said first engagement member being adapted to engage the at least one recess periphery on the first side of said snowboard boot when said binding is in a closed configuration, said first engagement member being adapted to only partially fill the at least one recess on the first side of said snowboard boot so that clearance is provided between said first engagement member and the top surface of the recess periphery when said binding is in the closed configuration; and a second engagement member supported by said base, said second engagement member being adapted to engage the second side of said snowboard boot when said binding is in the closed configuration.

49. A system according to claim 48, wherein the first engagement member includes a first pair of engagement members including first and second spaced apart engagement surfaces adapted to seperately engage the at least one recess on the first side of said snowboard boot.

50. A system according to claim 49, further comprising:

a handle pivotally connected to said first engagement member; and a link pivotally connected to said base and pivotally connected to said handle.

51. A system according to claim 50, wherein said binding is constructed and arranged so that said handle is pivoted in a first direction to close said binding, and wherein said binding is further constructed and arranged so that when said binding is in the closed configuration, compression forces generated by said snowboard boot on said link act to pivot said handle in the first direction.

52. A system according to claim 49, further including a handle mechanically coupled to said first engagement member, and wherein said binding is constructed and arranged so that when said handle is pivoted upwardly away from said base, said first engagement member slides to move said first engagement member toward said second engagement member.

53. A snowboard boot binding, comprising:

a base adapted to receive a snowboard boot;

a first engagement member supported by said base, said first engagement member being adapted to engage a first side of the snowboard boot when said binding is in a closed configuration;

a second engagement member supported by said base, said second engagement member being adapted to engage a second side of said snowboard boot disposed opposite the first side when said binding is in the closed configuration;

a handle mechanically coupled to said first engagement member so that actuation of said handle in a first direction moves said first engagement member toward said second engagement member to place said binding into the closed configuration; and means for arranging said binding so that forces generated by the snowboard boot on said binding that tend to move said first engagement member away from said second engagement member when said binding is in the closed configuration tend to actuate said handle in the first direction.

54. A snowboard boot binding according to claim 7, wherein the third engagement member is fixedly attached to said base.

55. A snowboard boot binding according to claim 33, wherein the third engagement member is fixedly attached to said base.

56. A snowboard binding according to claim 44, wherein said first engagement member is slidably mounted to said base.

57. A snowboard binding according to claim 53, wherein said first engagement member is slidably mounted to said base.

58. The snowboard boot binding according to claim 7, wherein one of the third engagement member and the first pair of engagement members is movably attached to the base.

59. The snowboard boot binding according to claim 58, wherein the other of the third engagement member and the first pair of engagement members is fixedly attached to the base.

60. The snowboard boot binding according to claim 7, further including a fourth engagement member, the third and fourth engagement members forming a second pair of engagement members, the third and fourth engagement members being spaced apart and adapted to separately engage first and second sections of the second side of the snowboard boot while being spaced from a third section of the second side of the snowboard boot disposed therebetween.

61. The snowboard binding according to claim 11, wherein said handle is pivotally connected to said first engagement plate.

62. The snowboard boot binding as claimed in claim 44, wherein one of the first engagement member and the second engagement member is movably mounted to said base.

63. The snowboard boot binding as claimed in claim 62, wherein the other of the first engagement member and the second engagement member is fixedly attached to said base.

64. The snowboard boot binding according to claim 48, wherein one of the first engagement member and the second engagement member is movably attached to said base.

65. The snowboard boot binding as claimed in claim 64, wherein the other of the first engagement member and the second engagement member is fixedly attached to said base.

66. The snowboard boot binding according to claim 48, wherein said first engagement member is beveled to facilitate engagement with the at least one recess on the first side of said snowboard boot.

67. The snowboard boot binding according to claim 48, wherein the second side of the snowboard boot includes at least one recess and said second engagement member is adapted to engage said at least one recess on the second side of snowboard boot.

68. The snowboard boot binding according to claim 67, wherein said second engagement member is beveled to facilitate engagement with the at least one recess on the second side of said snowboard boot.

69. The snowboard boot binding according to claim 67, wherein said second engagement member is adapted to only partially fill the at least one recess on the second side of said snowboard boot.

70. The snowboard boot binding according to claim 48, wherein the at least one recess on the first side of said snowboard boot is formed substantially in line with said first side of said snowboard boot.

71. The snowboard boot binding according to claim 70, wherein the second side of said snowboard boot includes at least one recess, said second engagement member is adapted to engage said at least one recess on said second side of said snowboard boot, and said at least one recess on said second side of said snowboard boot is formed substantially in line with the second lateral side of the boot.

72. The snowboard boot binding as claimed in claim 53, wherein one of the first engagement member and the second engagement member is movably mounted to said base.

73. The snowboard boot binding as claimed in claim 72, wherein the other of the first engagement member and the second engagement member is fixedly attached to said base.

74. A snowboard boot binding for securing a snowboard boot to a snowboard, the binding having an open position and a closed position, the binding comprising:

a base adapted to receive the snowboard boot;

a first engagement member mounted to the base for movement between an open configuration and a closed configuration respectively corresponding to the open and closed positions of the binding, the first engagement member being adapted to engage a first lateral side of the snowboard boot when in the closed configuration;

a second engagement member supported by the base and adapted to engage a second lateral side of the snowboard boot opposite the first lateral side when the binding is in the closed position; and an over-center locking mechanism that is mechanically coupled to the first engagement member and has an open state and a closed state respectively corresponding to the open and closed positions of the binding, the over-center locking mechanism being arranged to lock the first engagement member in the closed configuration when the over-center locking mechanism is in the closed state, the over-center locking mechanism being constructed and arranged such that compression forces generated by the snowboard boot on the binding that tend to move the first engagement toward the open configuration when the binding is in the closed position act to maintain the over-center locking mechanism in the closed state.

75. The snowboard boot binding according to claim 74, wherein said second engagement member is fixedly attached to said base.

76. A snowboard boot binding for securing a snowboard boot to a snowboard, the binding having an open position and a closed position, the binding comprising:

a base adapted to receive the snowboard boot;

a first engagement member mounted to the base for movement between an open configuration and a closed configuration respectively corresponding to the open and closed positions of the binding, the first engagement member being adapted to engage a first lateral side of the snowboard boot when in the closed configuration;

a second engagement member supported by the base and adapted to engage a second lateral side of the snowboard boot opposite the first lateral side when the binding is in the closed position; and an over-center locking mechanism that is mechanically coupled to the first engagement member, the over-center locking mechanism being arranged to lock the first engagement member in the closed configuration when the binding is in the closed position, the over-center locking mechanism being constructed and arranged such that compression forces generated by the snowboard boot on the binding when the binding is in the closed position act to maintain the first engagement member in the closed configuration;

wherein said first engagement member is adapted to engage at least one recess on the first lateral side of the snowboard boot, the first engagement member being further adapted to only partially fill the at least one recess on the first lateral side of the snowboard boot.

77. A snowboard boot binding for securing a snowboard boot to a snowboard, the binding having an open position and a closed position, the binding comprising:

a base adapted to receive the snowboard boot;

a first engagement member mounted to the base for movement between an open configuration and a closed configuration respectively corresponding to the open and closed positions of the binding, the first engagement member being adapted to engage a first lateral side of the snowboard boot when in the closed configuration;

a second engagement member supported by the base and adapted to engage a second lateral side of the snowboard boot opposite the first lateral side when the binding is in the closed position; and an over-center locking mechanism that is mechanically coupled to the first engagement member, the over-center locking mechanism being arranged to lock the first engagement member in the closed configuration when the binding is in the closed position, the over-center locking mechanism being constructed and arranged such that compression forces generated by the snowboard boot on the binding when the binding is in the closed position act to maintain the first engagement member in the closed configuration;

wherein said second engagement member is adapted to engage at least one recess on the second lateral side of the snowboard boot, the second engagement member being further adapted to only partially fill the at least one recess on the second lateral side of the snowboard boot.

78. The snowboard boot binding according to claim 74, further including a third engagement member, the first and third engagement members forming a first pair of engagement members, the first and third engagement members being spaced apart and adapted to separately engage first and third sections of the first side of the snowboard boot while being spaced from a second section of the first side of the snowboard boot disposed therebetween.

79. The snowboard boot binding according to claim 78, further including a fourth engagement member, the second and fourth engagement members forming a second pair of engagement members, the second and fourth engagement members being spaced apart and adapted to separately engage first and second sections of the second side of the snowboard boot while being spaced from a third section of the second side of the snowboard boot disposed therebetween.

80. The snowboard boot binding according to claim 74, further including a third engagement member, the second and third engagement members forming a pair of engagement members, the second and third engagement members being spaced apart and adapted to separately engage first and second sections of the second side of the snowboard boot while being spaced from a third section of the second side of the snowboard boot disposed therebetween.

81. A snowboard boot binding, comprising:

a base adapted to receive a snowboard boot;

a first pair of engagement members supported by the base and adapted to engage a first lateral side of the snowboard boot when the binding is in a closed configuration, the first pair of engagement members including first and second spaced apart engagement members adapted to separately engage first and second sections of the first lateral side of the snowboard boot while being spaced from a third section of the first lateral side of the snowboard boot disposed therebetween; and a third engagement member supported by said base, said third engagement member being adapted to engage a section of the snowboard boot spaced from the first lateral side when the binding is in the closed configuration.

82. The snowboard boot binding as claimed in claim 81, wherein one of the third engagement member and the first pair of engagement members is movably attached to the base.

83. The snowboard boot binding as claimed in claim 82, wherein the other of the third engagement member and the first pair of engagement members is fixedly attached to the base.

84. The snowboard boot binding as claimed in claim 81, wherein the third engagement member is adapted to engage a section of the snowboard boot disposed on a second lateral side of the snowboard boot.

85. The system of claim 48, wherein said first engagement member has a beveled surface.

86. The system of claim 35, wherein said first engagement member has an engaging portion that is adapted to be disposed within the at least one recess when said binding is in the closed configuration, wherein said engaging portion has a leading edge that is adapted to be disposed most deeply in the at least one recess, and wherein said engaging portion tapers to a wider portion disposed away from the leading edge.

87. The system of claim 48, wherein said first engagement member has an engaging portion that is adapted to be disposed within the at least one recess when said binding is in the closed configuration, wherein said engaging portion has a leading edge that is adapted to be disposed most deeply in the at least one recess, and wherein said engaging portion tapers to a wider portion disposed away from the leading edge.

88. The system of claim 48, wherein said first engagement member has a boot-facing surface that is adapted to be disposed within the at least one recess periphery when said binding is in the closed configuration, and wherein the boot-facing surface is a curved surface.

89. The system of claim 88, wherein the boot-facing surface is curved over its entire length.

90. A snowboard binding for securing a snowboard boot to a snowboard, wherein the snowboard boot has first and second sides, the first side including at least one recess periphery that defines at least one recess in the first side, the snowboard binding comprising:

a base adapted to receive the snowboard boot;

a first engagement member supported by the base, the first engagement member being adapted to engage the at least one recess periphery on the first side of the snowboard boot when the binding is in a closed configuration, the first engagement member having an engaging portion that is adapted to be disposed within the at least one recess when the binding is in the closed configuration, the engaging portion having a leading edge that is adapted to be disposed most deeply in the at least one recess, the engaging portion tapering to a wider portion disposed away from the leading edge; and a second engagement member supported by the base, the second engagement member being adapted to engage the second side of the snowboard boot when the binding is in the closed configuration.

91. The system of claim 90, wherein the first engagement member has a beveled surface.

92. The system of claim 90, wherein the first engagement member has a boot-facing surface that is adapted to be disposed within the at least one recess periphery when the binding is in the closed configuration, and wherein the boot-facing surface is a curved surface.

93. A snowboard binding for securing a snowboard boot to a snowboard, wherein the snowboard boot has first and second sides, the first side including at least one recess periphery that defines at least one recess in the first side, the snowboard binding comprising:

a base adapted to receive the snowboard boot;

a first engagement member supported by the base, the first engagement member being adapted to engage the at least one recess periphery on the first side of the snowboard boot when the binding is in a closed configuration, the first engagement member having a beveled surface; and a second engagement member supported by the base, the second engagement member being adapted to engage the second side of the snowboard boot when the binding is in the closed configuration.

94. The snowboard boot binding of claim 74, wherein the first engagement member includes a pair of spaced apart engagement members adapted to seperately engage first and second sections of the first side of the snowboard boot while being spaced from a third section of the first side of the snowboard boot disposed therebetween.

95. The snowboard boot binding of claim 94, wherein each of the pair of spaced apart engagement members is adapted to engage an in-step area of the snowboard boot.

96. The snowboard boot binding of claim 94, wherein the pair of engagement members is mounted to base for movement relative to the base and is mechanically coupled so that the pair of engagement members move together as a unit.

97. The snowboard boot binding of claim 94, in combination with the snowboard boot, wherein the first side of the snowboard boot includes at least one recess adapted to receive the pair of engagement members.

98. The snowboard boot binding of claim 94, in combination with the snowboard boot, wherein the first side of the snowboard boot includes a pair of recesses adapted to receive the pair of engagement members.

99. The snowboard boot binding of claim 74, wherein the over-center locking mechanism has a member that is in compression when the over-center locking mechanism is in the closed state and compression forces are generated by the snowboard boot on the binding.

100. The snowboard boot binding of claim 7, wherein the first and second spaced apart engagement members are formed as a single integral component.

101. The snowboard boot binding of claim 7, wherein the first pair of engagement members is mounted to base for movement relative to the base.

102. The snowboard boot binding of claim 101, wherein the first and second spaced apart engagement members are mechanically coupled so that the first and second spaced apart engagement members move together as a unit.

103. The snowboard boot binding of claim 7, wherein each of the first and second spaced apart engagement members is arranged to engage the snowboard boot in a mid-section of the boot.

104. The snowboard boot binding of claim 102, wherein each of the first and second spaced apart engagement members is arranged to engage the snowboard boot in an in-step area of the boot.

105. The snowboard boot binding of claim 7, wherein the first and second spaced apart engagement members include a forward engagement member and a rearward engagement member, wherein the forward engagement member is arranged to engage the snowboard boot in an in-step area of the boot, and wherein the rearward engagement member is arranged to engage the snowboard boot rearwardly of the forward engagement member.

106. The snowboard boot binding of claim 7, wherein the third engagement member includes a pair of spaced apart engagement members adapted to separately engage first and second sections of the second side of the snowboard boot while being spaced from a third section of the second side of the snowboard boot disposed therebetween.

107. The snowboard boot binding of claim 7, in combination with the snowboard boot, wherein the first side of the snowboard boot includes at least one recess adapted to receive the first pair of engagement members.

108. The snowboard boot binding of claim 7, in combination with the snowboard boot, wherein the first side of the snowboard boot includes a pair of recesses adapted to receive the first pair of engagement members.

* * * * *